United States Patent [19]

Meyer

[11] 3,979,798

[45] Sept. 14, 1976

[54] EYELET

[76] Inventor: Hans H. Meyer, Gittertor 14, 3327 Salzgitter-Bad, Germany

[22] Filed: Mar. 29, 1974

[21] Appl. No.: 456,308

[52] U.S. Cl. ..... 24/141
[51] Int. Cl.[2] ..... A43C 5/00
[58] Field of Search ..... 24/141, 142, 73, 90, 24/208

[56] References Cited

UNITED STATES PATENTS

| | | | |
|---|---|---|---|
| 3,751,793 | 8/1973 | Davis | 24/141 |
| 3,812,809 | 5/1974 | Salmon | 24/141 |

*Primary Examiner*—Werner H. Schroeder
*Assistant Examiner*—Doris L. Troutman
*Attorney, Agent, or Firm*—Murray Schaffer

[57] ABSTRACT

An eyelet for transmitting the high tensile forces of tie members engaging through the opening of the eyelet to a tarpaulin canvas or the like sheet. The eyelet consists of two ring-shaped complementary plastic clamping halves having mutually opposite inner flat surfaces holding the material of the tarpaulin between them. A metal jacket binds the aperature of the eyelet, overlapping the two clamping halves and pressing them together. Inside the clamping halves, vertical holes are provided, wherein rigid not flexible anchoring pins are inserted passing through the sheet material and reaching almost to the inner surface of the metal jacket.

6 Claims, 4 Drawing Figures

EYELET

BACKGROUND OF THE INVENTION

The present invention relates to an eyelet construction for tarpaulin, canvas and similar sheet like material, and in particular to an eyelet construction capable of transmitting the tensile force of the guy rope or wire to the tarpaulin without destruction or tearing of the eyelet or tarpaulin.

In general, the known construction of eyelets comprise two annular parts which are compressed together after being placed on either side of the sheet material. In this execution, the tarpaulin is only held by a clamping action between the parts of the eyelet. In order to increase the tensile forces to be transmitted by the eyelet to the tarpaulin, it has been attempted to provide the two surfaces of the clamping parts resting directly on the tarpaulin with ring-shaped or pin-like projections, which in the cross-section of the clamping parts present a profile resembling serrations. However, clamping force necessary to connect the eyelet parts, cause these projections to damage the tarpaulin material. As a result, in relation to clamping parts having smooth walls, no appreciable increase in the tensile forces, that can be transmitted to the tarpaulin, occurs through the attempted profiling.

It is an object of the present invention to provide an eyelet of the type mentioned above by that, without damage to the tarpaulin-type material in the clamping zone of the eyelet, the load capacity of the eyelet can be increased quite considerably without risk of tearing.

These objects, others and numerous advantages will be apparent from the following disclosure of the preferred form of the present invention.

SUMMARY OF INVENTION

According to the present invention an eyelet construction is provided in which the eyelet comprises a pair of annular plastic mating parts adapted to clamp together, about a hole formed in a tarpaulin or canvas sheet. The eyelets are made of plastic for economy, due function and ease of handle, and have a metal jacket for exterior strength. Each eyelet is provided with several anchoring pins extending approximately vertically through the tarpaulin and held in aligned holes provided in the annular clamping parts. The anchoring pins are uniformly distributed over the periphery of the eyelet, and in the mounted state of the eyelet almost touch the inner surface of the metal jacket. The anchoring pins are non-bending and pointed at the ends in the manner of needles.

Through the above mentioned design of the eyelet the result obtained is that the anchoring pins are inserted without damage to the tarpaulins and the plastic clamping parts, and act in conjunction with the other components of the eyelet to obtain a particularly high tensile load capacity and to resiliently take over forces loading the material.

Full details of the present invention are illustrated in the accompanying drawings and set forth in the following description.

DESCRIPTION OF THE INVENTION

Figure 1:
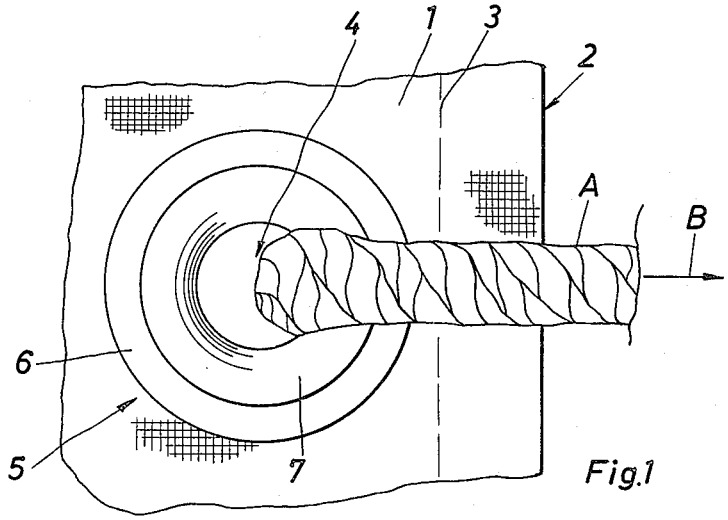
FIG. 1 shows in plan, a portion of a tarpaulin having an eyelet attached thereto tarpaulin-type material.

As seen in FIG. 1, a sheet tarpaulin 1, such as a canvas sail or tent side, is provided with a marginal edge 2 hemmed along a seam 3. Spaced along the seam are one of more holes 1*a* about which is secured a grommet or eyelet, generally referred to by the numeral 5. The eyelet 5 has a central aperture 4 conforming to the hole 1*a*.

A pull rope or tie cord A passes through the aperture 4 and is normally stretched to apply a tensile force on the tarpaulin in the direction of the arrow B.

Figure 2:
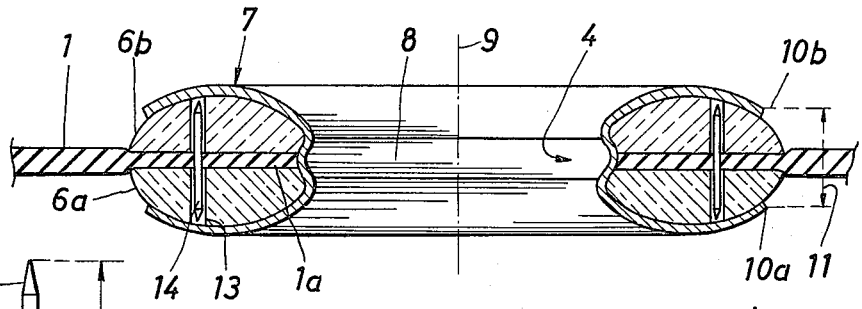
FIG. 2, is an enlarged cross-section through the eyelet of FIG. 1, FIG. 3, shows in cut-out form a plan view of the eyelet according to FIG. 2, with metal jacket partly broken away.

As seen in detail in FIG. 2, the eyelet comprises a pair of clamping halves 6*a* and 6*b*. The clamping halves are annular and have lenticular convexly vaulted cross-section with a planar mating surface. The clamping halves are made from a hard rigid plastic or the like and are covered by an outer metal jacket 7. The jacket 7 starts initially as a cylindrical hollow tube, or rivet having a head at one end, and is compressed by suitable means into the shape seen. Once the jacket is compressed the clamping halves 6*a* and 6*b* enclose between them the marginal zone of holes 1*a* which were previously punched in the tarpaulin and exert a clamping action, the clamping pressure being produced by compressing the metal jacket 7, which is transformed from the hollow cylindrical part, or rivet-like part by means of a compression operation, into the strongly resilient form that may be seen in FIG. 2. The metal jacket 7 is provided approximately on the plane of the tarpaulin 1 with a compression flange 8, which reduces the resilience capacity of the jacket material in order to transmit to the clamping parts 6*a* and 6*b* the highest possible clamping pressure of the jacket 7. The metal jacket is thus provided wiith a circumferential opening on its outer edge, and is symmetrical about a central axis 9. The opening provides a pair of free annular edges 10*a* anad 10*b*, being spaced from each other a distance 11 allowing the sheet tarpaulin to extend from the clamping halves 6*a* and 6*b*.

Figure 3:
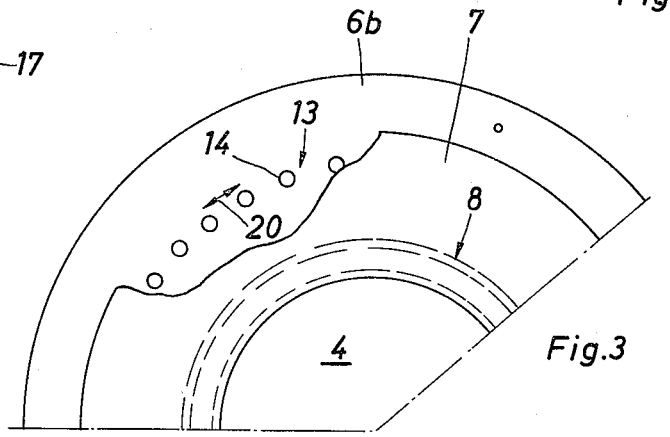

Each of the clamping halves 6*a* and 6*b* are provided with a plurality of holes 13, extending parallel to the axis 9 and thus transversely to the plane of the sheet tarpaulin. The holes 13 are uniformly spaced radially about the axis 9 as seen in FIG. 3 and are aligned so that they extend axially with each other. Located in each of the holes 13 is an anchoring pin 14. The anchoring pins 14 are made of rigid non-bendible material, such as metal or plastic and have pointed ends 15 in the manner of needles. The pins 14 are thus insertable through the tarpaulin, without the need for forming or punching little holes for them. Preferably, the anchoring pins have a length 17 extending almost from one surface of the metal jacket to the other, and thus extend through both of the opposed clamping halves 6*a* and 6*b*.

As seen in FIG. 3, the pins 14 are uniformly spaced at a distance 20, about the periphery of the eyelet 5. Preferably, the anchoring pins 14 are arranged at a reciprocable peripheral distance, indicated by the arrows 20 of about the order of magnitude of their diameters.

Figure 4:
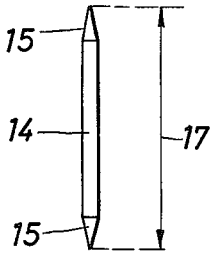
FIG. 4, shows an enlarged scale a side view of an anchoring pin.

It will be observed that the metal jacket 7 overlaps with its free ends 10*a* and 10*b* the clamping halves 6*a* and 6*b* to such an extend that the spacing 11 (FIG. 2) between the free edges 10*a* and 10*b* is less than the length 17 (FIG. 4) of the anchoring pins 14 which in the mounted state according to FIG. 2 extend as far as the immediate vicinity of the metal jacket 7. As a result, the free edges 10*a* and 10*b* of the metal jacket 7 must first be widened and separated from each other beyond the distance 7, by the action of the pins 14 on their inner surfaces before the eyelet 5 as a whole can tear loose.

The anchoring pins are subjected solely to shearing stress and transmit the forces acting on them only through the flexible clamping parts which consist of plastic to the metal jacket. In this way the mechanical load on the plastic clamping parts is kept relatively low. The metal jacket acts as an abutment and has to be widened in the event of the stretching of the clamping parts. To effect this not only a deformation of the metal jacket, but also the overcoming of very great frictional forces between the metal jacket and the plastic clamping parts are needed. In the event of the stretching of the plastic clamping parts, the anchoring pins act directly in conjunction wiith the metal jacket, and transfer a portion of the forces exerted on them to the metal jacket, and their ends penetrate the metal jacket and thus form anchoring points with the metal jacket.

Through the uniform distribution of the anchoring pins over the periphery of the eyelet a favorable distribution of forces takes place and a high load capacity at constant level in every possible direction of pull is obtained.

As the tarpaulins are not damaged through the needle-pointed-ends of the anchoring pins when the latter are inserted, the pins can be arranged at a reciprocal peripheral distance of about the order of magnitude of their diameter, without destroying the hole 1*a*.

In order to be able to transmit in an optimum manner the desired clamping force to the clamping halves, it is recommended that the arrangement be carried out in such a way that the metal jacket has a central ring-shaped compression flange, approximately on the plane of the tarpaulin-type material.

It has been found that an eyelet according to the invention, with an eyelet aperture of about 4 cm inner diameter and a total diameter of about 7 cm can be stressed without damage with a tensile force of 1800 kg.

Various changes and modifications can be made. The presend disclosure is intended as being illustrative, and not as limiting the scope of the invention.

What is claimed is:

1. An eyelet for tying flexible sheet material, such as tarpaulin-type sails under high tensile forces comprising a pair of annular complementary clamping halves mutually reversed outer walls and mutually opposite inner flat surfaces for receiving the flexible material between them, a metal jacket binding overlapping the two clamping halves and pressing them together, said clamping halves having a plurality of axially aligned holes extending completely through said outer walls and inner flat surfaces uniformly arranged about their central axis and a separable rigid non flexible anchoring pin extending through each of said holes, said pins having needle-like pointed ends penetrating the flexible material, and extending to the inner surface of said jacket adjacent each of the clamping halves.

2. The eyelet according to claim 1, wherein said clamping halves are plastic.

3. The eyelet according to claim 1, wherein the metal jacket has an annular compression flange lying approximately on the plane of the flat surfaces of the clamping halves between which the flat flexible material is compressed.

4. The eyelet according to claim 1, wherein the metal jacket has an annular compression flange lying approximately on the plane of the material.

5. The eyelet according to claim 1, wherein said clamping means have lenticularly vaulted outer wall.

6. The eyelet according to claim 1, wherein said pins are freely movable axially in said holes.

* * * * *